United States Patent [19]

Celico

[11] Patent Number: 4,837,959

[45] Date of Patent: Jun. 13, 1989

[54] MARKER DEVICE

[76] Inventor: Joseph M. A. Celico, Iroquois Ave., Westerly, R.I. 02891

[21] Appl. No.: 53,506

[22] Filed: May 15, 1987

Related U.S. Application Data

[63] Continuation-in-part of Ser. No. 835,151, Mar. 3, 1986, abandoned.

[51] Int. Cl.[4] ..... G09F 7/00

[52] U.S. Cl. ..... 40/584; 40/612; 40/299; 40/665; 40/632

[58] Field of Search ..... 40/584, 21 C, 10 C, 40/299, 640, 665, 612; 24/17 PB, 16 PB

[56] References Cited

U.S. PATENT DOCUMENTS

| | | | |
|---|---|---|---|
| 2,554,105 | 5/1951 | Heinle | 24/16 PB |
| 2,617,215 | 11/1952 | Morris | 40/21 R |
| 2,639,181 | 5/1953 | Moberg | 40/21 R |
| 2,642,684 | 6/1953 | Watts | 40/10 C |
| 2,799,953 | 7/1957 | Sage | 40/10 C |
| 2,846,796 | 8/1958 | Polzin | 40/21 C |
| 3,197,830 | 8/1965 | Hoadley | 24/16 |
| 3,231,992 | 2/1966 | Swett | 40/21 R |
| 3,280,790 | 10/1966 | Booth | 116/173 |
| 3,486,262 | 12/1969 | Gregoire | 40/607 |
| 3,489,076 | 1/1970 | Countryman | 240/21 C |
| 3,495,568 | 2/1970 | Palinkos | 116/173 |
| 3,530,544 | 9/1970 | Burniston | 24/16 PB |
| 3,640,242 | 2/1972 | Guinn et al. | 116/173 |
| 3,731,347 | 5/1973 | Caveney et al. | 24/16 |
| 3,735,449 | 5/1973 | Rosales | 24/16 |
| 4,470,173 | 9/1984 | Adamson | 24/16 |
| 4,615,185 | 10/1986 | Bollinger | 40/21 C |

*Primary Examiner*—Gene Mancene
*Assistant Examiner*—Michael Lynch
*Attorney, Agent, or Firm*—Albert W. Hilburger

[57] ABSTRACT

A highly visible pennant intended to mark a particular location is combined with a fastener permitting it to be readily attached to an existing supporting structure. The pennant may be appropriately formed of semirigid material enabling it to extend horizontally outwardly a substantial distance from the supporting structure without dropping. The fastener is positioned at one end of the pennant and the opposite, free, end is wrapped around the supporting structure, then through a receiving slot formed in the fastener, and drawn tight. The fastener, which may be integral with the pennant or of a separate construction and fixedly attached to the pennant, has a resiliently mounted clamp member with teeth positioned to permit the pennant to advance through the slot but to engage the pennant and prevent its withdrawal. A release member can be provided to enable selective removal of the pennant from the fastener.

11 Claims, 5 Drawing Sheets

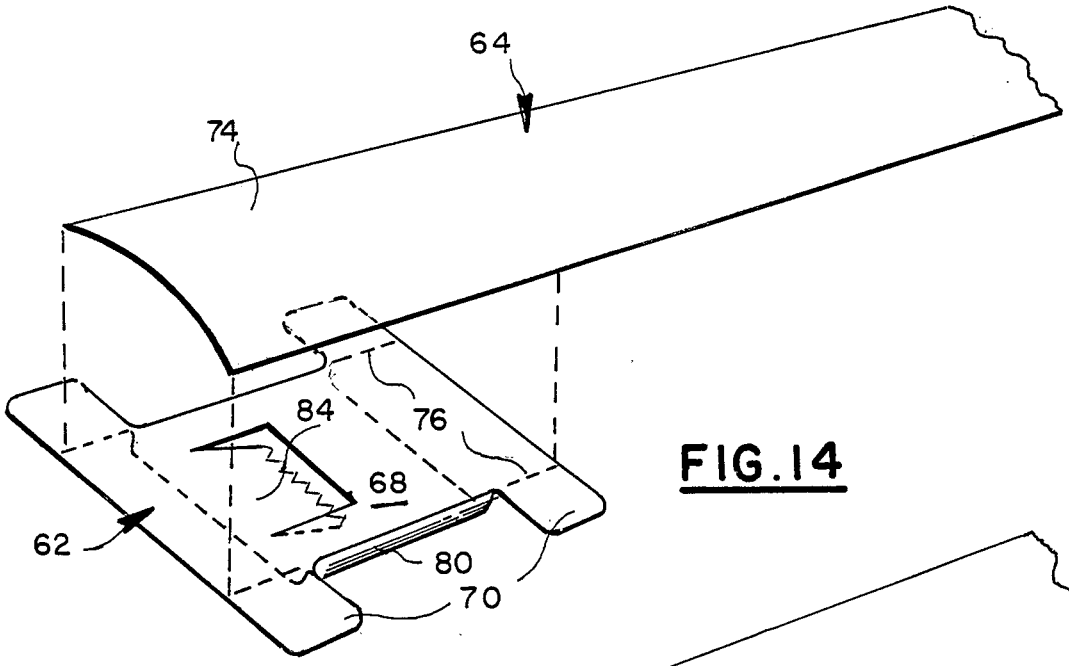
FIG. 14
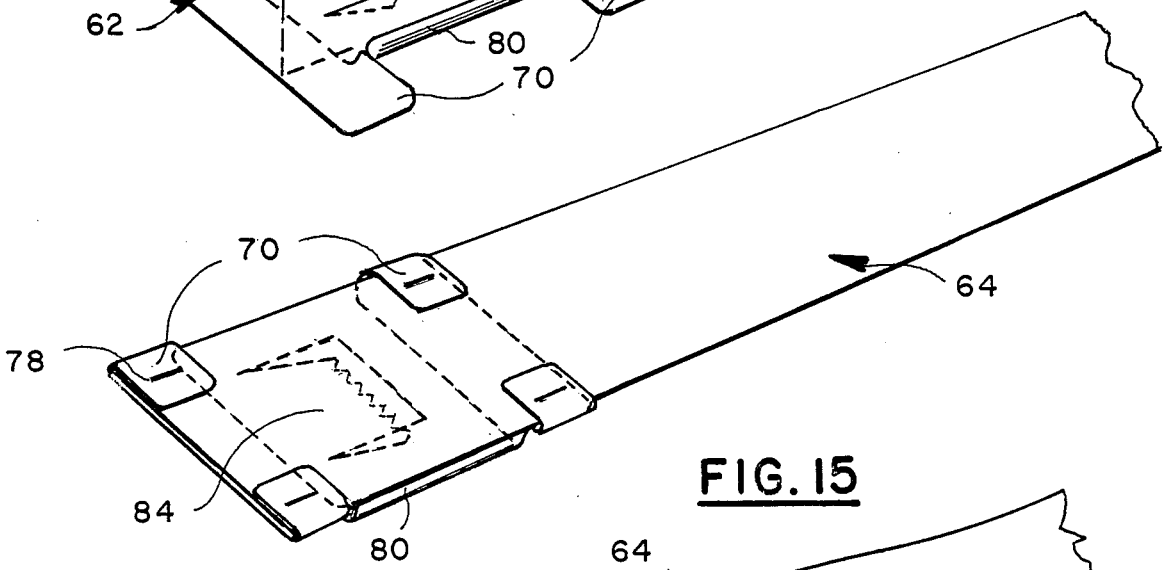
FIG. 15
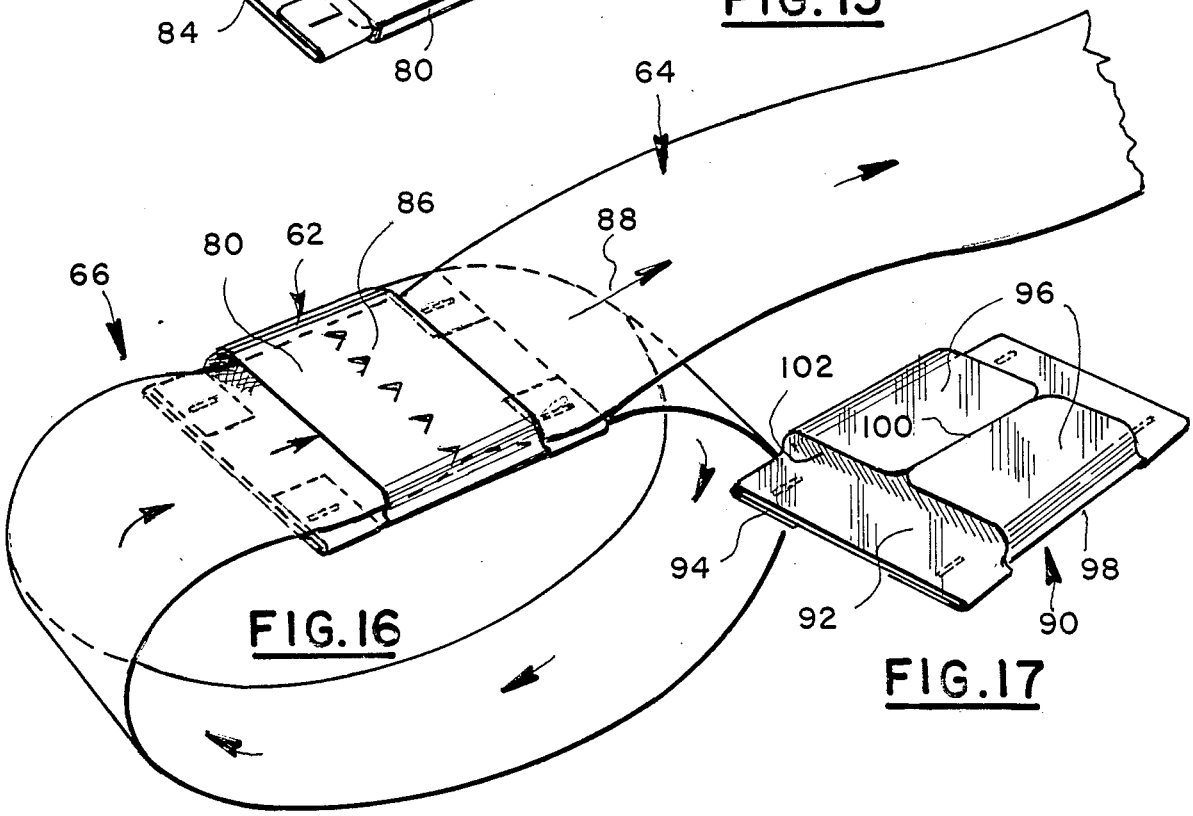
FIG. 16
FIG. 17

MARKER DEVICE

This is a continuation-in-part of co-pending application Ser. No. 835,151 filed on Mar. 3, 1986, now abandoned.

BACKGROUND OF THE INVENTION

I. Field of the Invention

The present invention relates to the combination of a highly visible marker and a fastener for readily attaching the marker to a supporting structure.

II. Description of the Prior Art

According to currently available statistics, each school year three hundred thirty thousand buses travel several billion miles while transporting millions of children to and from school. All this is accomplished with remarkable regularity and has resulted in an extremely good safety record. Nonetheless, each school year there are nearly one hundred school bus related deaths. The victims are usually between the ages of five and eleven. Some of the children are struck by their own school bus and others are injured by vehicles passing the bus while the bus in the "loading zone", that is, the area around the bus.

In the past, there has been no concerted effort to mark school bus stops or loading zones in the manner in which the stops for commercial bus routes are marked. One reason for this fact is that commercial routes are essentially limited to main thoroughfares and change little from year to year. In contrast, school bus routes necessarily follow the streets and roads of residential areas and can change drastically from year to year depending upon the student population. For example, when a group of students who have customarily used an elementary bus loading zone graduate to high school, they will often assemble at another location and at another time to await the high school bus. With this transition, there may be no elementary students remaining at the original loading zone, or so few that those remaining congregate at yet another location.

The choice of a school bus stop or loading zone location is often that of the students without regard to safety or route efficiency. This is not as it should be. Rather, the choice should be that of school administrators applying any necessary information available from parents and bus drivers. The locations should be chosen most importantly for safety, and also for maximum route efficiency considering the residential location of the students. Safety requires that a stop location be highly visible and, to the greatest extent possible, away from a region of heavy traffic.

Previously, flags, signs, pennants, and the like have been devised to be removably mounted on some kind of a supporting structure such as on an automobile antenna (U.S. Pat. Nos. 3,280,790 and 3,495,568), on the end of a dowel (U.S. Pat. No. 3,640,242), and on a post or tree trunk (U.S. Pat. No. 3,486,262). In the first three instances, very specific and individualized constructions are disclosed. In the latter instance, the sign is attached by a separate tie line cut to length, then tied around the post or tree trunk to each end of the sign.

Also known are one-piece strap fasteners of flexible material which have been devised as closures for containers as in the instance disclosed in U.S. Pat. No. 4,470,173 and for securing bundles as in the instances disclosed in U.S. Pat. Nos. 3,197,830, 3,731,347, and 3,735,449. Constructions in which a strap fastener is integral with a sign, flag, pennant or the like and used for mounting that article on a supporting structure are disclosed in U.S. Pat. Nos. 2,642,684, 2,846,796, 3,231,992, and 4,615,185. However, there are no instances known to the inventor in which a user has the ability to selectively choose the proper length of a pennant depending upon the size of a particular supporting structure and depending upon the length of the message to be displayed on the pennant.

SUMMARY OF THE INVENTION

It was with knowledge of the prior art and the problems existing which gave rise to the present invention. In brief, the present invention is directed towards a highly visible pennant intended to mark a particular location. The pennant is combined with a fastener permitting it to be readily attached to an existing supporting structure. The pennant may be appropriately formed of semirigid material enabling it to extend horizontally outwardly a substantial distance from the supporting structure without drooping. The fastener is positioned at one end of the pennant and the opposite, free, end is wrapped around the supporting structure, then through a slot formed in the fastener, and drawn tight. The fastener, which may be integral with the pennant or of a separate construction and fixedly attached to the pennant, has teeth positioned to permit the pennant to advance through the slot but to engage the pennant and prevent its inadvertent withdrawal. A release member can be provided to enable selective removal of the pennant from the fastener.

One highly desirable use for the marker being disclosed is for purposes of locating a school bus stop or loading zone. By using the invention, school officials can, annually or more often, as needed, establish bus stops or loading zones for the school bus system. This can be done by affixing a marker to an object at the chosen location such as at a telephone pole, an electrical service pole, a mail box, a tree, a fence post, or the like. In short, to be an appropriate supporting structure, an object must be easily seen and substantially permanent. The marker then serves as a "stop target" for the bus stop or loading zone. This is for the benefit, not only of the students, but for that of the bus drivers and passing motorists. In the case of motorists casually passing by, it serves to alert them to the fact that this is a location at which to exercise particular caution. In the case of motorists who pass by routinely, they are reminded to exercise caution at particular times and locations which they come to know from repeated travel past the location of the marker.

Subsequently, when the location of the bus stop or loading zone is changed, the marker can be removed and it, or a replacement marker, affixed at the new location for the loading zone. In a preferred embodiment of the invention, the marker is constructed so as to be removable and can be replaced elsewhere. Also, it is desirable for the marker to be highly visible by reason of its size, shape, and colors employed. It might also be desirable to print on the marker, besides information indicating that the location is a school bus stop, other forms of information, for example, the name of the particular school which the bus stop serves and the times for scheduled bus stops.

Of course, the invention need not be restrictive to the use as a stop target for a school bus loading zone. Rather, it is applicable to any situation in which a marker is desired which can be readily and releasably attached to an object.

Accordingly, it is an object of the invention to provide a marker which is adapted to serve as a stop target for a school bus stop or other loading and unloading zone.

A primary object of the invention is to provide a marker which can be withdrawn at will from a continuous supply of elongated material, then cut to the desired length depending upon the message to be presented and depending upon the size of the supporting structure.

Another object of the invention is to provide an independent fastener which can be attached to an end of the marker resulting from the operation recited in the preceding object, thereby enabling the marker to be attached to the supporting structure.

It is another object of the invention to provide a marker which is highly visible and can be readily attached to a supporting structure and readily detachable therefrom.

It is also an object of the invention to provide a marker having the foregoing characteristics which is composed of weather impervious materials.

It is still a further object of the invention to provide a marker of the nature already recited which can be inexpensively manufactured and be disposable, if desired.

Still a further object of the invention is the provision of a marker having any of the characteristics already recited which is provided with a universal fastener which enables the marker to be mounted on a variety of supporting structures.

Other and further features, objects, advantages, and benefits of the invention will become apparent from the following description taken in conjunction with the following drawings. It is to be understood that both the foregoing general description and the following detailed description are exemplary and explanatory but not restrictive of the invention.

The accompanying drawings which are incorporated in, and constitute a part of this invention, illustrate some of the embodiments of the invention and, together with the description serve to explain the principles of the invention in general terms. Throughout the drawings, like numerals refer to like parts.

BRIEF DESCRIPTION OF THE DRAWINGS

FIG. 14 is an exploded perspective view illustrating the two major parts of the embodiment of the invention collectively illustrated in FIGS. 11–16;

FIG. 15 is a perspective view, similar to FIG. 14, but illustrating the two major parts in their assembled condition;

FIG. 16 is a perspective view illustrating the embodiment of FIGS. 11--15 in its operational condition;

FIG. 17 is a detail perspective of a modified part for the invention; and

DESCRIPTION OF THE PREFERRED EMBODIMENTS

Figure 1:
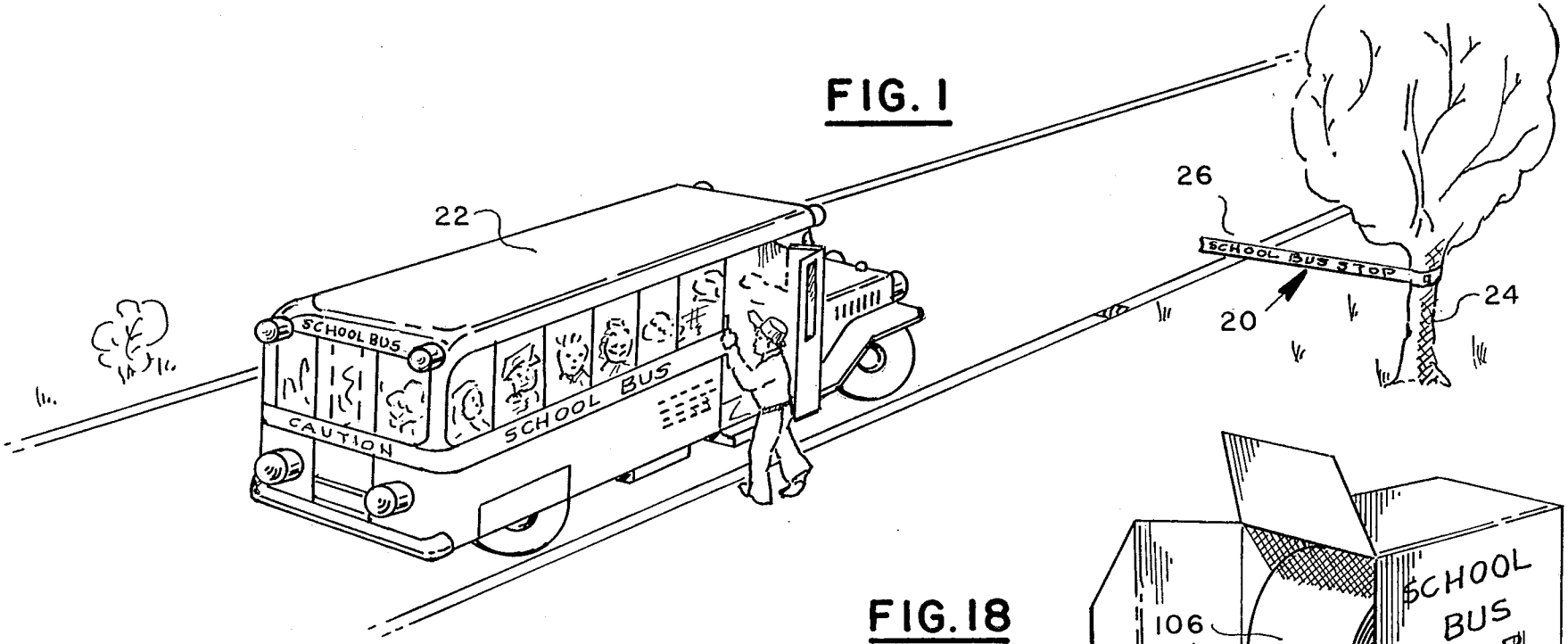
FIG. 1 is a perspective view illustrating a typical use for the invention.

Turn now to the drawings, and initially to FIG. 1 which illustrates one typical use of a marker device 20 embodying the invention. In this instance, it is used as a stop target to indicate the stop location or loading zone for a school bus 22. In a typical fashion, the marker device 20 is illustrated as being attached to the trunk of a tree 24.

Figure 2:
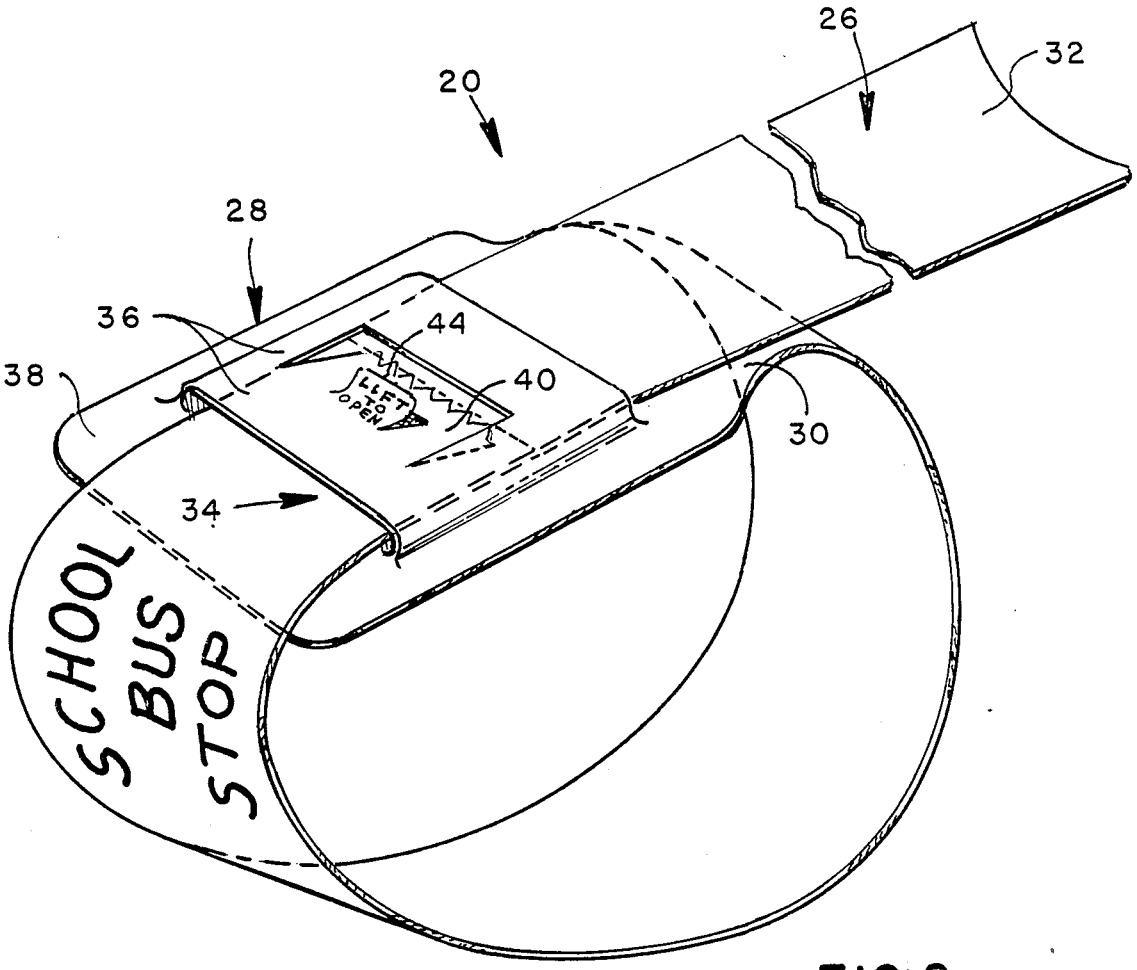
FIG. 2 is a perspective view of one embodiment of the invention in its operational condition.
Figure 3:
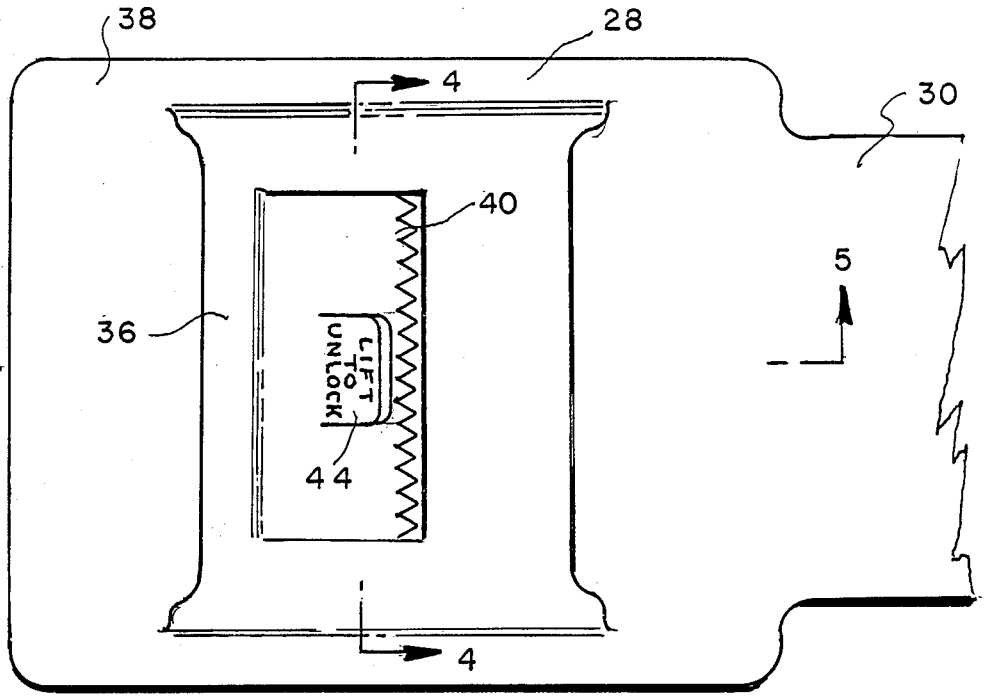
FIG. 3 is a detail top plan view illustrating one end of the marker device illustrated in FIG. 2.

One embodiment of the invention is illustrated in FIGS. 2–7. According to this embodiment, the marker device 20 includes an elongated pennant 26 and a fastener 28 integral with the pennant. The marker device 20 may be of any suitable flexible material including a range of plastic materials, one example being polyethylene. The pennant 26 has one end 30 which is adapted to be positioned adjacent a supporting structure, such as the trunk of the tree 24 and a free end 32 extending in a direction away from the end 30. The first end 30 merges or blends in with the fastener 28 as best seen in FIG. 3. As seen in FIG. 2, the free end 32 is drawn into a loop to encircle a supporting structure (not shown in FIG. 2) such as the trunk of the tree 24, then proceeds through a reception region 34 defined as that region lying between a bridge 36 and a base 38.

Figure 4:
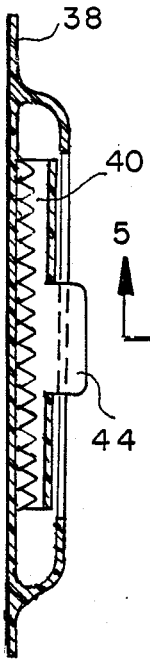
FIG. 4 is a cross section view taken generally along line 4—4 in FIG. 3.
Figure 5:
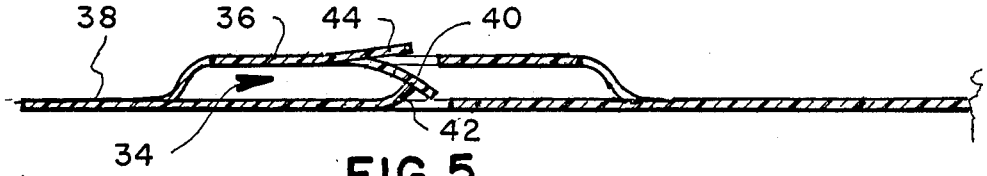
FIG. 5 is a cross section view taken generally along line 5—5 in FIG. 3.
Figure 6:
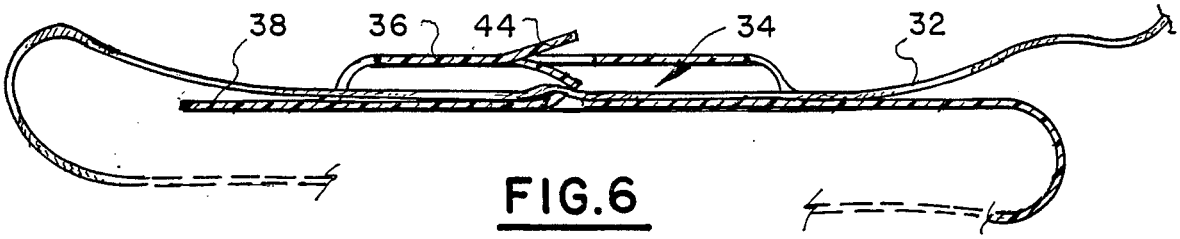
FIG. 6 is a cross section view, similar to FIG. 5, but depicting the operational condition illustrated in FIG. 2.
Figure 7:
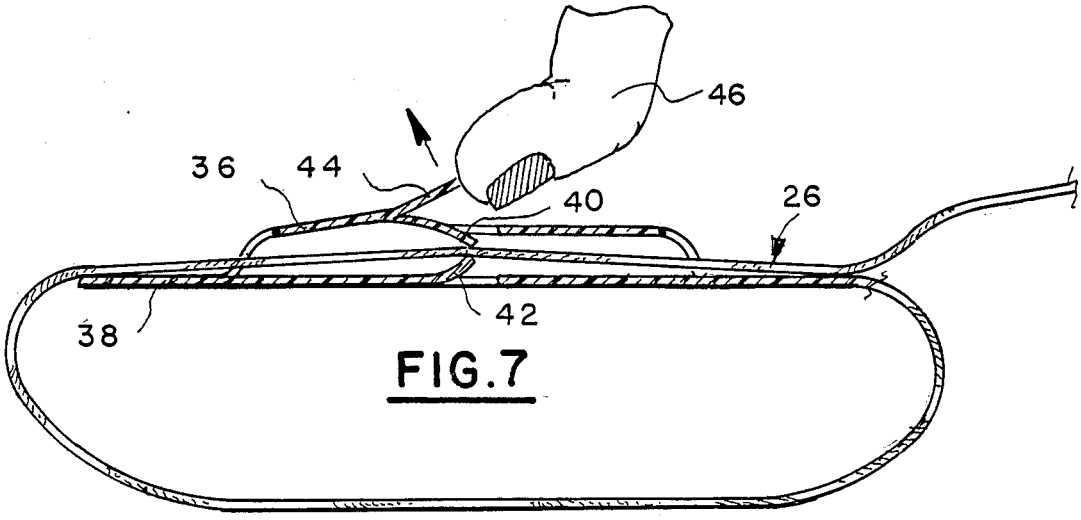
FIG. 7 is cross section view, similar to FIG. 6, illustrating the operation of a mechanism to withdraw the pennant portion from the fastener portion.
Figure 11:
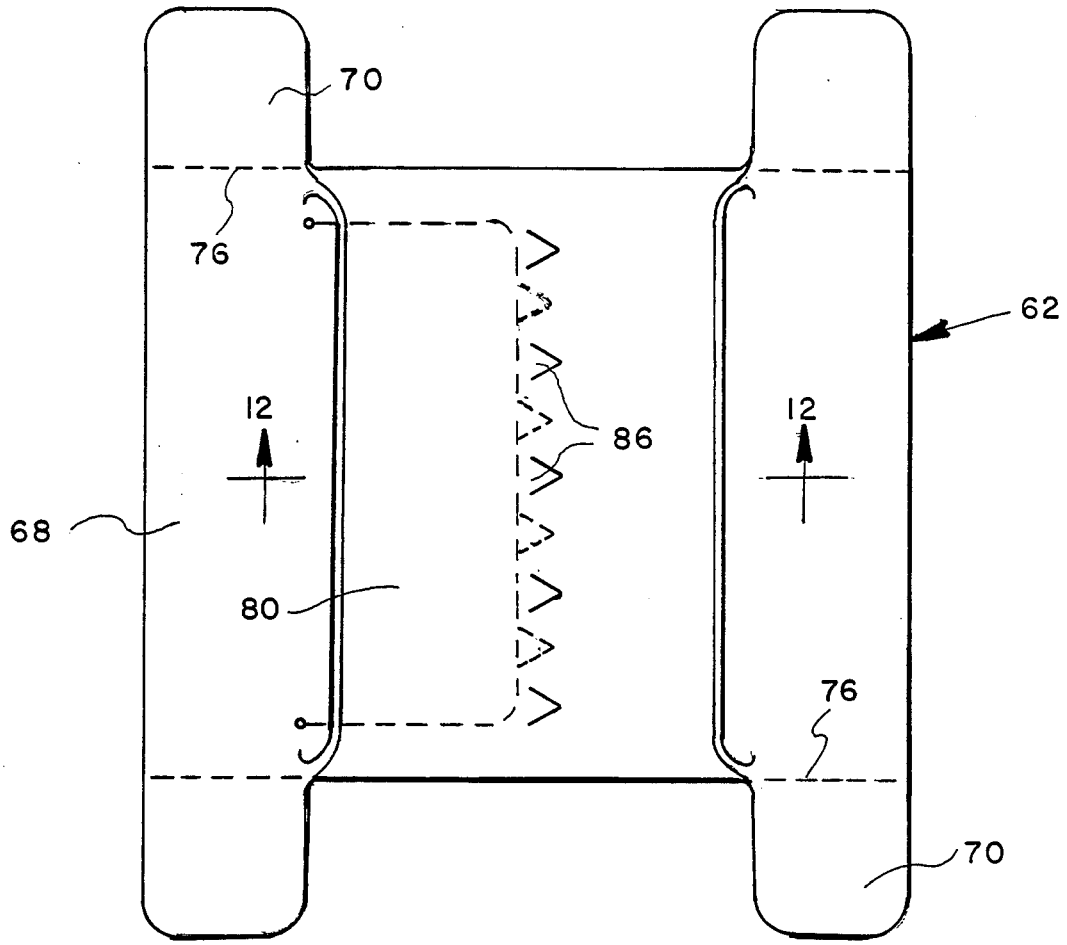
FIG. 11 is a top plan view of one part of another embodiment of the invention.
Figure 12:
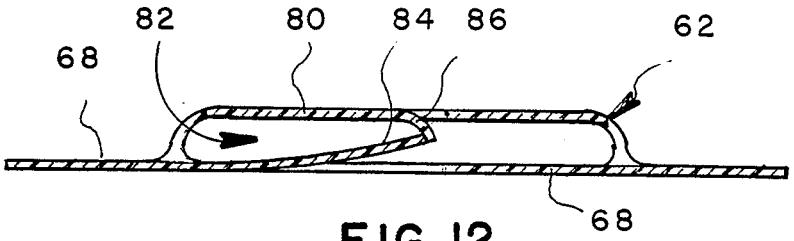
FIG. 12 is a cross section view taken generally along line 12—12 in FIG. 11.
Figure 13:
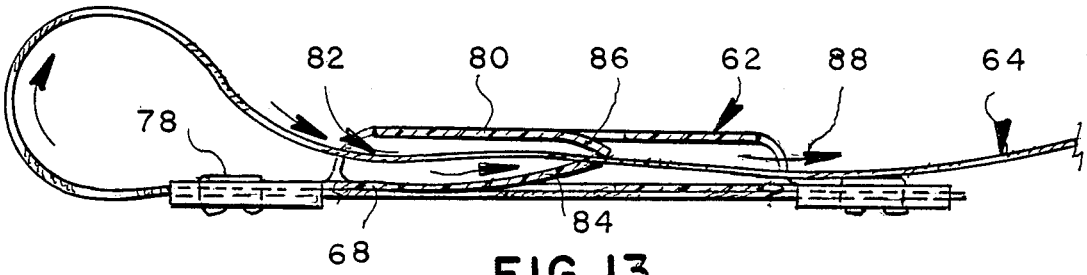
FIG. 13 is cross section view, similar to FIG. 12, illustrating a combination of the two major parts comprising the embodiment collectively illustrated in FIGS. 11—16.

As particularly well seen in FIGS. 3, 4, and 5, a toothed clamp member 40 is fashioned out of the bridge 36 and extends into the reception region 34. The clamp member 40 is normally biased so as to engage an upturned, laterally extending lip 42 extending upwardly into the reception region 34 from the base 38. Thus, as the free end 30 is advanced into the reception region 34, it engages the clamp member 40 and the lip 42 and causes them to separate as indicated in FIG. 6. However, the teeth on the clamp member 40 continue to engage the outer surface of the pennant 26. The clamp member 40 and lip 42 are so constructed as to freely allow the pennant member to advance through the reception region 34. At the same time, should a tug occur on the pennant in the opposite direction, teeth of the clamp member 40 grippingly engage the pennant 26 and normally prevent its withdrawal from the reception region 34. It will also be appreciated that the material of which the pennant 26 is composed may be stretchable such that when the free end is drawn taut, then released, that portion of the pennant nearest the teeth of the clamp member 40 will be caused to advance, then relax into engagement with the teeth.

The clamp member 40 may also be provided with a release ear 44 which extends out of the plane of the clamp member 40. The relase ear can be selectively lifted by a finger 46 of an operator (see FIG. 7) to thereby raise the teeth of the clamp member 40 from the pennant 26. Without the release ear 44, attempted withdrawal of the pennant 32 from the reception region 34 might result in tearing of the pennant 26 by the teeth of the clamp member 40 and in its eventual destruction.

In the manner indicated in FIG. 1, it is desirable for the elongated pennant 26 of the marker device 20 to extend outwardly from the trunk of the tree 24 or other supporting structure without drooping. This result is achieved by the marking device 20. Specifically, for this purpose, the marker device 20 is preferably composed of a semirigid material, whether metal or plastic. Additionally, it is desirable to at least provide a bow to the material in a direction transverse of its longitudinal axis. This bow is generally seen at the free end 32 in FIG. 2. Another way of describing this bowed construction is that the pennant 26 is formed so as to lie in a curved plane whose axis extends generally parallel to the longitudinal axis of the pennant.

Figure 9:
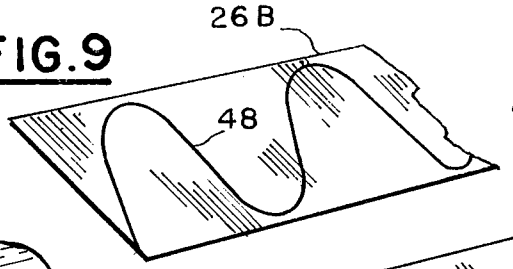
FIG. 9 is a detail perspective view illustrating a modified use of the pennant.
Figure 8:
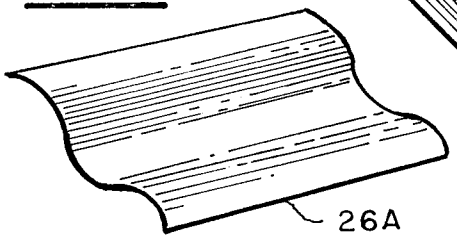
FIG. 8 is a detail perspective view illustrating a portion of a pennant modified from the construction illustrated in FIGS. 2–7.

Other constructions which are useable with the invention are illustrated in FIGS. 8 and 9. In FIG. 8, a portion of an elongated pennant 26A is illustrated having corrugations aligned generally with a longitudinal axis thereof. In a similar fashion, a portion of an elongated pennant 26B is illustrated in FIG. 9. In this instance, although the pennant 26B may be planar, it may be composed of a suitable plastic material having a strengthening wire 48 embedded therein and assuming a sinusoidal pattern along the length of the pennant. Of course, it can also be envisioned to combine any of these various strengthening expedients should that prove to be desirable. In any event, such expedients enable the marker device 20 to be fashioned from light weight materials and still assume a relatively rigid deployment in use.

Figure 10:
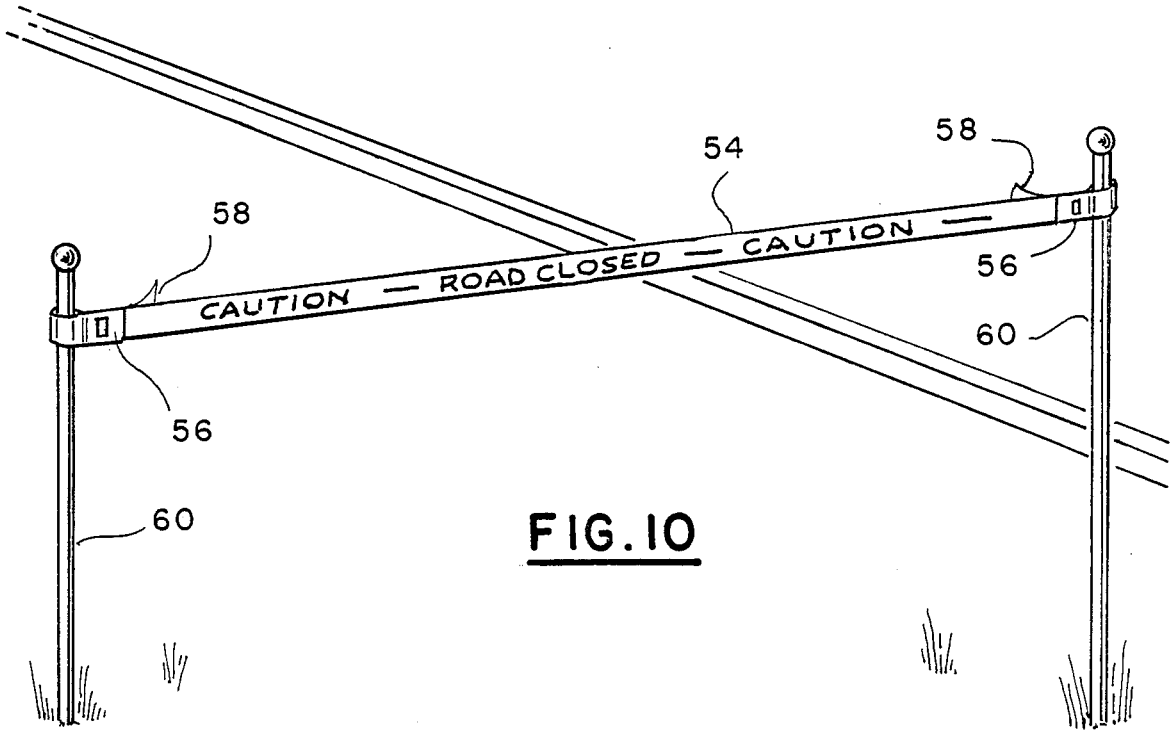
FIG. 10 is a perspective view illustrating another typical use for the invention.

It has earlier been mentioned that the use of the invention is not necessarily limited to being a stop target for locating a school bus stop or loading zone. Indeed, the invention can serve a host of uses where a zone or area is to be readily and easily marked for as long or short a period of time as desired. In FIG. 10 there is illustrated an elongated pennant 54 with fasteners 56 at both ends thereof embodying the invention, the ends 58 of the pennant being drawn around suitable upright poles 60. The construction illustrated in FIG. 10 is an example of the use to which the marker device of the invention can be put to extend over long distances. In this instance, the pennant 54 is drawn across a highway to indicate to motorists that the highway, or a portion thereof, is temporarily closed.

Another embodiment of the invention is illustrated generally in FIGS. 11–16 according to which a fastener 62 may be formed separately from a pennant 64, then affixed to the pennant before the step of mounting a resulting marker device 56 onto a suitable supporting structure (not shown). In this embodiment, the fastener 62, similar to the fastener 28, has a base 68 with outwardly extending tabs 70 at each of its corners.

As seen in FIG. 14, the fastener 62 is placed onto a first end 74 of the pennant 64 so as to be contiguous with the pennant. After it is properly aligned, the tabs 70 of the fastener 62 are folded over along score lines 76 so as to grippingly engage the pennant. In a succeeding step, staples 78 or other suitable attachment means can be used to join the fastener 62 in an integral fashion with the pennant 64.

In this embodiment, the fastener 62 is preferably composed of a plastic material formed, possibly, by injection molding. As with the fastener 28, the fastener 62 has a bridge 80 which, together with the base 68, defines a reception region 82 into which and through which the pennant 64 can be advanced. As the pennant 64 advances through the reception region 82, it engages an upturned clamp member 84 biased upwardly from the base 68 and teeth 86 extend downwardly from the bridge 80 and cooperate with teeth formed on the clamp member 84 so as to engage the pennant 64. The clamp member 84 and the teeth 86 cooperate to permit the pennant 64 to advance in the direction of arrows 88 (FIGS. 13 and 15) but seizingly grip the banner 64 to prevent its withdrawal from the fastener 62. Of course, the fastener 62 may be provided with a structure equivalent to the release ear 44 to enable withdrawal of the pennant whenever that should be desired.

While the fastener 62 can be readily fashioned from plastic material using injection molding techniques as presently noted, it might be difficult to fashion out of metal by currently known techniques. For this reason, it might be desirable to provide a fastener 90 having many of the features of the fastener 62, but with the added ability of being fabricated from sheet metal using an inexpensive stamping process. Specifically, as illustrated in FIG. 17, the fastener 90, which may be fashioned out of metal, although plastic materials may also be used, has a base member 92, tab members 94, generally equivalent to the tabs 70, and results in a construction having a pair of cantilevered bridge members 96. At the outset of the fabrication process, it will be appreciated that the bridge members 96 are coplanar with the base member 92, then folded along edges 98 of the base member toward one another so that their extremities meet along a common line 100 overlying the base member 92 and defining a reception region 102 through which a free end of the pennant 64 can advance. In all other respects, the fastener 90 may be similar to the fasteners 62 and 28.

Figure 18:
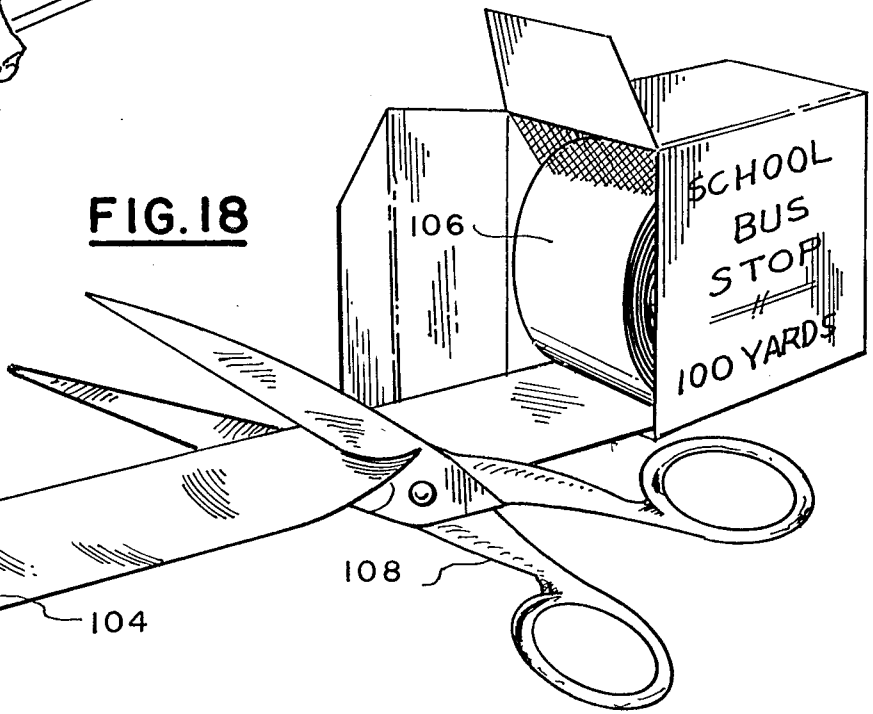
FIG. 18 is a perspective view illustrating the cutting of pennant material drawn from a packaged roll for use in the embodiments of FIGS. 11–17.

The constructions disclosed in the embodiments of FIGS. 11–17 enable material 104 for a pennant to be drawn from a packaged roll 106 (see FIG. 18) and cut to a desired length by a scissors 108 or other suitable cutting instrument. Another typical cutting instrument might be, for example, a serrated metallic or hard plastic edge located at the opening of the box from which the material 104 is withdrawn. It will be appreciated that pennant lengths vary from purpose to purpose and, by reason of the invention, a user is not limited to specific lengths, but can choose whatever length is most appropriate for a particular purpose. In one instance, the length of a pennant will vary depending upon the particular supporting structure to which it is to be mounted. For example, a greater length will be necessary if the supporting structure is a large diameter tree, while a much smaller length will be necessary if the supporting structure is a small diameter pole. In another instance, the length of the pennant will vary according to the quantity of information to be presented on its surface. In any event, the invention will accommodate all of these needs.

While preferred embodiments of the invention have been disclosed in detail, it should be understood by those skilled in the art that various other modifications may be made to the illustrated embodiments without departing from the scope as described in the specification and defined in the appended claims.

I claim:

1. A portable system of marking a site with marker apparatus adapted to be releasably attached to a supporting structure comprising:

a continuous supply of elongated pennant material capable of being hand held;

an elongated pennant having a first end drawn from said continuous supply of elongated pennant material and severable from the remainder of said pennant material to thereby define a second end a preselected distance from said first end;

independent fastener means including a base member and an integral bridge thereon defining a reception region therebetween;

attachment means for fixing said base member to said first end, said attachment means including a plurality of tab members on said base member extending away therefrom, said tab members being foldable, when said base member overlies one side of said first end, to engage the opposite side of said first end, and joining means extending, respectively, through each of said tab members, through said base member and through said pennant to thereby attach said base member to said first end;

said first end of said pennant with said fastener means thereon adapted to be positioned adjacent the supporting structure with said second end extending away from said first end;

the reception region defined by said fastener means lying generally tangent to the supporting structure for slidably receiving said second end therethrough enabling said pennant, preceded by said second end, to encircle the supporting structure and extend through the reception region such that with continued movement of said second end away from said first end, said pennant can be manually drawn to tightly engage the supporting structure;

said fastener means including resilient gripping means freely allowing said pennant member to advance through the reception region, said gripping means being movable between an engaged position seized with said pennant to prevent it from retracting through the reception region, said fastener means including a release member on said gripping means for selectively moving said gripping means between said engaged position and said disengaged position;

whereby said pennant and said fastener means lie in parallel, contiguous planes when said pennant is drawn to tightly engage the supporting structure.

2. A system of marking as set forth in claim 1 wherein:

said pennant is of semirigid material lying in a curved plane whose axis extends generally parallel to the longitudinal axis of said pennant.

3. A system of marking as set forth in claim 1 wherein:

said pennant has a longitudinal axis and is of semirigid material having corrugations therein generally aligned with the longitudinal axis of said pennant.

4. A system of marking as set forth in claim 1 wherein:

said pennant is of generally planar semirigid plastic material including a strengthening wire embedded therein generally assuming a sinusoidal pattern and extending continuously between said first and said second ends.

5. A system of marking as set forth in claim 1 wherein:

said gripping means is normally biased into said engaged position.

6. A system of marking as set forth in claim 1 wherein:

said fastener means and said pennant are composed of semirigid plastic material.

7. A system of marking as set forth in claim 1 wherein:

said pennant is composed of a resilient material whereby that portion thereof encircling the supporting structure is caused to tightly engage the supporting structure when said second end is drawn to a maximum distance away from said first end and thereupon released.

8. A system of marking as set forth in claim 1 wherein:

said gripping means includes:

a resiliently mounted clamp member having a plurality of teeth thereon extending transversely of the path of said pennant through said reception region and in the direction of advance of said pennant therethrough, said teeth being oriented and positioned to allow said pennant to advance through said region but to seize said pennant to prevent retraction thereof.

9. A system of marking as set forth in claim 1 wherein:

said fastener means includes a planar metal sheet defining said base member;

said tab members; and said bridge, said bridge being a pair of opposed bridge members integral with said base member and extending away therefrom, said bridge members being foldable toward one another to overlie said base member and meet along a common line to thereby define the reception region therebetween.

10. A system of marking as set forth in claim 1 wherein said continuous supply includes a packaged roll of the elongated pennant material.

11. A method of providing a highly visible marker on a supporting structure comprising the steps of:

providing a substantially continuous source of elongated pennant material capable of being hand held;

withdrawing the pennant material from the source;

swvering an arbitrary length of the pennant material from the source so as to define a pennant member having first and second ends;

providing a fastener means with a base member and a plurality of tab members thereon extending away therefrom;

causing the base member to overlie one side of the first end;

foldling the tab members so as to engage the opposite side of the first end;

joining the tab members, the base member and the first end together;

affixing to the first end a fastener means having an integral bridge which lies in a plane generally parallel to that of the the pennant member so as to define a reception region between the pennant member and the bridge, the reception region also lying generally in a plane parallel to that of the pennant;

with the first end held stationary adjacent the supporting structure, encircling the supporting structure with the pennant member led by the second end; inserting the second end through the reception region;

providing the fastener means with resilient gripping means extending into the reception region so as to freely allow the pennant member to advance through the reception region but engageable with the pennant member to prevent it from retracting through the reception region; and drawing the second end away from the supporting structure until the fastener means and the pennant material in the region adjacent to the first end lies tangentially and contiguous to the supporting structure with the gripping means engages with the pennant member to prevent it from retracting through the reception region.

* * * * *